US008088540B2

(12) United States Patent
Abe et al.

(10) Patent No.: US 8,088,540 B2
(45) Date of Patent: Jan. 3, 2012

(54) PHOTORECEPTOR FOR ELECTROPHOTOGRAPHY

(75) Inventors: Katsumi Abe, Fukushima (JP); Makoto Koike, Fukushima (JP); Atsushi Takesue, Fukushima (JP)

(73) Assignee: Hodogaya Chemical Co., Ltd., Tokyo (JP)

( * ) Notice: Subject to any disclaimer, the term of this patent is extended or adjusted under 35 U.S.C. 154(b) by 785 days.

(21) Appl. No.: 12/161,896

(22) PCT Filed: Jan. 18, 2007

(86) PCT No.: PCT/JP2007/050721

§ 371 (c)(1),
(2), (4) Date: Jul. 23, 2008

(87) PCT Pub. No.: WO2007/083714

PCT Pub. Date: Jul. 26, 2007

(65) Prior Publication Data

US 2009/0011349 A1 Jan. 8, 2009

(30) Foreign Application Priority Data

Jan. 23, 2006 (JP) ..... 2006-014036

(51) Int. Cl.
*G03G 5/00* (2006.01)

(52) U.S. Cl. ..... 430/58.45; 430/58.65; 430/58.75; 430/58.8; 430/58.85; 430/133

(58) Field of Classification Search ..... 430/58.45, 430/58.65, 58.75, 58.8, 58.85, 133
See application file for complete search history.

(56) References Cited

FOREIGN PATENT DOCUMENTS

JP 55 42752 11/1980

(Continued)

OTHER PUBLICATIONS

Abstract of JP 63-208865 (corresponds to JP 8-010360), Takashi et al., Aug. 30, 1988.*

(Continued)

*Primary Examiner* — Mark Chapman
(74) *Attorney, Agent, or Firm* — Oblon, Spivak, McClelland, Maier & Neustadt, L.L.P.

(57) ABSTRACT

An object of the invention is to provide a photoreceptor for electrophotography which has a low residual potential in an initial stage, is inhibited from increasing in residual potential, is prevented from decreasing in charge potential, undergoes little fatigue deterioration even upon repeated use, and is less apt to pose a problem concerning toxicity or environmental pollution. The invention relates to a photoreceptor for electrophotography which has a photosensitive layer containing an aromatic hydroxycarboxylic acid metal complex represented by the following general formula (1):

[Chem. 1]

(1)

and one or more charge-transporting agents each having an arylaminophenyl group in the molecule.

24 Claims, 3 Drawing Sheets

FOREIGN PATENT DOCUMENTS

| | | |
|---|---|---|
| JP | 61 69073 | 4/1986 |
| JP | 64 44946 | 2/1989 |
| JP | 1 118845 | 5/1989 |
| JP | 3 78753 | 4/1991 |
| JP | 7 126225 | 5/1995 |
| JP | 7 244422 | 9/1995 |
| JP | 8 10360 | 1/1996 |
| JP | 8 110648 | 4/1996 |
| JP | 8 211636 | 8/1996 |
| JP | 9 43877 | 2/1997 |
| JP | 9 202762 | 8/1997 |
| JP | 2858324 | 12/1998 |
| JP | 2001 51433 | 2/2001 |
| JP | 2004-212889 | 7/2004 |

OTHER PUBLICATIONS

Extended European Search Reported issued in European Application No. 07707025.8, issued Aug. 30, 2011.

* cited by examiner

PHOTORECEPTOR FOR ELECTROPHOTOGRAPHY

TECHNICAL FIELD

The present invention relates to a photoreceptor for electrophotography. More particularly, the invention relates to a photoreceptor for electrophotography which changes little in charge potential and residual potential even upon repeated use and has excellent durability.

BACKGROUND ART

Inorganic photoconductive substances such as selenium, zinc oxide, cadmium sulfide, and silicon have hitherto been used extensively in photoreceptors for electrophotography. Although these inorganic substances have many merits, they had various drawbacks. For example, selenium has drawbacks that it necessities difficult production conditions and that selenium is apt to crystallize with heat or mechanical impact. Zinc oxide and cadmium sulfide have problems concerning moisture resistance and mechanical strength and further have a drawback that these substances deteriorate in suitability for charge or exposure by the action of a dye added as a sensitizer, resulting in poor durability. Silicon also necessitates difficult production conditions and further necessitates use of a highly irritant gas, resulting in a high cost. Silicon is sensitive to moisture and, hence, care should be taken in handling. In addition, selenium and cadmium sulfide have a problem concerning toxicity.

Organic photoreceptors which employ various organic compounds and in which those drawbacks of inorganic photoreceptors have been mitigated are in extensive use. The organic photoreceptors include single-layer type photoreceptors in which a charge-generating agent and a charge-transporting agent have been dispersed in a binder resin, and multilayer type photoreceptors in which functions have been allotted to a charge-generating layer and a charge-transporting layer. A feature of the latter photoreceptors, which are called the function allocation type, resides in that materials suitable for the respective functions can be selected from a wide range. Because a photoreceptor having any desired performances can be easily produced, many investigations on that type have been made.

Various improvements such as development of novel materials and combinations of these have been made in order to satisfy the performances required of photoreceptors for electrophotography, such as basic performances and high durability, as described above. However, a satisfactory photoreceptor has not been obtained so far.

Although organic materials have many merits not possessed by inorganic materials, no organic photoreceptor which satisfies all the properties required of photoreceptors for electrophotography has been obtained so far. Namely, organic photoreceptors suffer a decrease in charge potential, increase in residual potential, change in sensitivity, etc. due to repeated use and this results in deterioration in image quality. Although the causes of this deterioration have not been fully elucidated, decomposition or the like of the charge-transporting agent, etc. caused by: the active gases generating upon charge by corona discharge, such as ozone and $NO_x$; the ultraviolet contained in the exposure light and erase light; and heat are considered to serve as some factors. Known techniques for inhibiting such deterioration include a technique in which a hydrazone compound is used in combination with an antioxidant (see, for example, patent document 1), a technique in which a butadiene compound is used in combination with an antioxidant (see, for example, patent document 2), and a technique in which a hydrazone compound is used in combination with a metal complex or metal salt of an aromatic carboxylic acid (see, for example, patent document 3). However, photoreceptors having satisfactory initial sensitivity are not sufficiently inhibited from deteriorating with repeated use, while ones reduced in deterioration with repeated use have problems concerning initial sensitivity and electrification characteristics. Furthermore, in the case of using a metal salt or the like and the metal is chromium, there is a possibility that this photoreceptor might be causative of environmental pollution. As described above, the effect of inhibiting the deterioration has not been sufficiently obtained so far.

Patent Document 1: JP-A-1-044946
Patent Document 2: JP-A-1-118845
Patent Document 3: Japanese Patent No. 2858324

DISCLOSURE OF THE INVENTION

Problems that the Invention is to Solve

Accordingly, an object of the invention is to provide a photoreceptor for electrophotography which has a low residual potential in an initial stage, is inhibited from increasing in residual potential, is prevented from decreasing in charge potential, undergoes little fatigue deterioration even upon repeated use, and is less apt to pose a problem concerning toxicity or environmental pollution.

Means for Solving the Problems

The invention provides a photoreceptor for electrophotography which comprises a conductive support and a photosensitive layer formed on the support, the photosensitive layer containing an aromatic hydroxycarboxylic acid metal complex represented by the following general formula (1):

[Chem. 1]

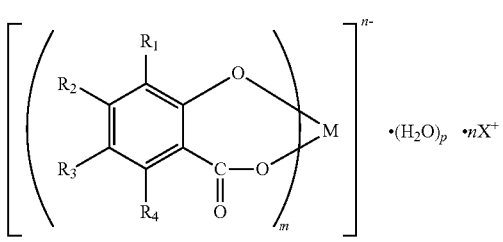

(1)

(wherein R1, R2, R3, and R4 may be the same or different and each represent hydrogen, a linear or branched alkyl group having 1-8 carbon atoms, or a linear or branched alkenyl group having 2-8 carbon atoms, provided that R1 and R2, or R2 and R3, or R3 and R4 may be bonded to each other to form a ring; M represents a metal; $X^+$ represents a cation; m is an integer of 1-3; n is an integer of 1 or 2; and p is an integer of 0-3) and one or more charge-transporting agents each having an arylaminophenyl group in the molecule. The invention further provides a process for producing the photoreceptor for electrophotography.

The charge-transporting agents each having an arylaminophenyl group in the molecule may be ones in which the aryl group is bonded to the phenyl group to form a polycyclic structure. In a preferred form of general formula (1), R1 and R3 each are an alkyl group having 1-8 carbon atoms, R2 and R4 each are hydrogen, M is a metal having a valence of 2 (excluding Hg) or 3 (excluding Cr), and X is a monovalent cation.

Specific examples of the metal M represented by M in general formula (1) include divalent metals such as Zn and trivalent metals such as Al, Co, Fe, Mn, Ni, and Ti.

Examples of the cation represented by $X^+$ in general formula (1) include a hydrogen ion, alkali metal ions, ammonium ion, organic ammonium ions, and mixtures of two or more thereof.

It is preferred that the photosensitive layer of the photoreceptor for electrophotography of the invention contains, as the charge-transporting agents having an arylaminophenyl group in the molecule, one or more hydrazone compounds represented by the following general formula (2), (3), or (4):

[Chem. 2]

(2)

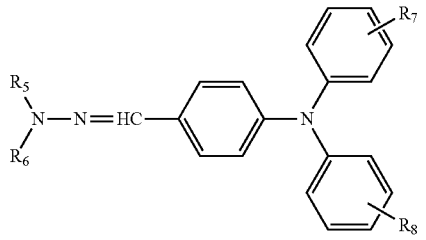

(wherein R5 and R6 may be the same or different and each represent a linear or branched alkyl group having 1-12 carbon atoms, a substituted or unsubstituted linear aralkyl group having 7-20 carbon atoms, a substituted or unsubstituted branched aralkyl group having 7-20 carbon atoms, or a substituted or unsubstituted aryl group having rings; and R7 and R8 may be the same or different and each represent a hydrogen atom, a linear or branched alkyl group having 1-12 carbon atoms, a substituted or unsubstituted linear aralkyl group having 7-20 carbon atoms, a substituted or unsubstituted branched aralkyl group having 7-20 carbon atoms, a linear or branched alkoxy group having 1-4 carbon atoms, a substituted or unsubstituted aryloxy group, an acyl group, an alkoxycarbonyl group having 2-5 carbon atoms, a halogen atom, a nitro group, an amino group substituted with one or two alkyl groups having 1-4 carbon atoms, or a substituted or unsubstituted amide group; provided that when R5 to R8 further have a substituent, then the substituent may be a halogen atom, alkoxy group, aryloxy group, dialkylamino group, or alkylthio group, and that R5 or R6 may further have an alkyl group only when it is an aryl group);

[Chem. 3]

(3)

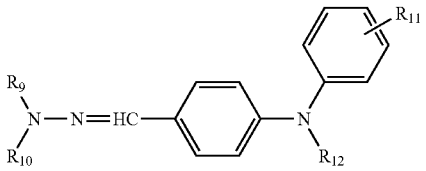

(wherein R9 and R10 may be the same or different and each represent a linear or branched alkyl group having 1-12 carbon atoms, a substituted or unsubstituted linear aralkyl group having 7-20 carbon atoms, a substituted or unsubstituted branched aralkyl group having 7-20 carbon atoms, or a substituted or unsubstituted aryl group having 1-4 rings; R11 represents a hydrogen atom, a linear or branched alkyl group having 1-12 carbon atoms, a substituted or unsubstituted linear aralkyl group having 7-20 carbon atoms, a substituted or unsubstituted branched aralkyl group having 7-20 carbon atoms, a linear or branched alkoxy group having 1-4 carbon atoms, a substituted or unsubstituted aryloxy group, an acyl group, an alkoxycarbonyl group having 2-5 carbon atoms, a halogen atom, a nitro group, an amino group substituted with one or two alkyl groups having 1-4 carbon atoms, or a substituted or unsubstituted amide group; and R12 represents a linear or branched alkyl group having 1-12 carbon atoms, a substituted or unsubstituted linear aralkyl group having 1-12 carbon atoms, or a substituted or unsubstituted branched aralkyl group having 1-12 carbon atoms; provided that when R9 to R12 further have a substituent, then the substituent may be a halogen atom, alkoxy group, aryloxy group, dialkylamino group, or alkylthio group, and that R9 or R10 may further have an alkyl group only when it is an aryl group);

[Chem. 4]

(4)

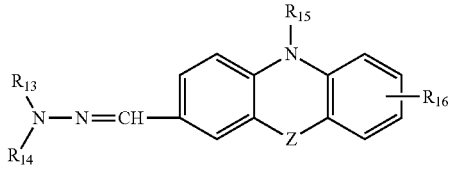

(wherein Z represents O, S, or a divalent group represented by N(R15); R13 and R14 may be the same or different and each represent a linear or branched alkyl group having 1-12 carbon atoms, a substituted or unsubstituted linear aralkyl group having 7-20 carbon atoms, a substituted or unsubstituted branched aralkyl group having 7-20 carbon atoms, or a substituted or unsubstituted aryl group having 1-4 rings; R16 represents a hydrogen atom, a linear or branched alkyl group having 1-12 carbon atoms, a substituted or unsubstituted linear aralkyl group having 7-20 carbon atoms, a substituted or unsubstituted branched aralkyl group having 7-20 carbon atoms, a linear or branched alkoxy group having 1-4 carbon atoms, a substituted or unsubstituted aryloxy group, an acyl group, an alkoxycarbonyl group having 2-5 carbon atoms, a halogen atom, a nitro group, an amino group substituted with one or two alkyl groups having 1-4 carbon atoms, or a substituted or unsubstituted amide group; and R15 represents a linear or branched alkyl group having 1-12 carbon atoms, a substituted or unsubstituted linear aralkyl group having 1-12 carbon atoms, or a substituted or unsubstituted branched aralkyl group having 1-12 carbon atoms; provided that when R13 to R16 further have a substituent, then the substituent may be a halogen atom, alkoxy group, aryloxy group, dialkylamino group, or alkylthio group, and that R13 or R14 may further have an alkyl group only when it is an aryl group).

It is alternatively preferred that the photosensitive layer of the photoreceptor for electrophotography of the invention contains, as the charge-transporting agents having an arylaminophenyl group in the molecule, one or more styryl compounds represented by the following general formula (5):

[Chem. 5]

(5)

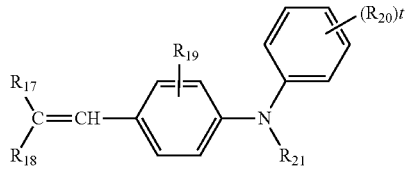

(wherein R17 and R18 may be the same or different and each represent a substituted or unsubstituted phenyl group, a substituted or unsubstituted naphthyl group, a substituted or unsubstituted anthryl group, a substituted or unsubstituted fluorenyl group, or a substituted or unsubstituted heterocyclic group, the substituents being any of an alkyl group, alkoxy group, halogen atom, hydroxyl group, and phenyl group, each of which may be further substituted; R19 represents hydrogen, a halogen atom, an alkyl group having 1-8 carbon atoms, an alkoxy group having 1-8 carbon atoms, or a mono- or dialkylamino group; R20 represents a hydrogen atom, an alkyl group having 1-8 carbon atoms, an alkoxy group having 1-8 carbon atoms, a halogen atom, or a mono- or di-substituted amino group; t is an integer of 1 or 2; when t=2, then the two substituents may be the same or different and the two substituents may be bonded to each other to form a tetramethylene ring or trimethylene ring; and R21 represents a substituted or unsubstituted phenyl group, the substituent being any of an alkyl group, alkoxy group, halogen atom, hydroxyl group, and substituted or unsubstituted phenyl group, each of which may be further substituted).

It is alternatively preferred that the photosensitive layer of the photoreceptor for electrophotography of the invention contains, as the charge-transporting agents having an arylaminophenyl group in the molecule, one or more benzidine compounds represented by the following general formula (6):

[Chem. 6]

(6)

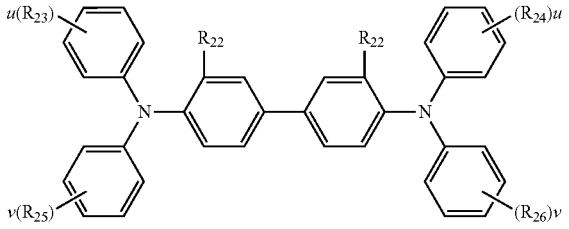

(wherein R22 represents a hydrogen atom, an alkyl group having 1-8 carbon atoms, an alkoxy group having 1-8 carbon atoms, or a halogen atom; R23, R24, R25, and R26 may be the same or different and each represent a hydrogen atom, an alkyl group having 1-8 carbon atoms, an alkoxy group having 1-8 carbon atoms, a halogen atom, or a mono- or di-substituted amino group; u is an integer of 1 or 2; when u=2, then the two substituents bonded to the same phenyl group may be the same or different; v is an integer of 1 or 2; and when v=2, then the two substituents bonded to the same phenyl group may be the same or different).

It is alternatively preferred that the photosensitive layer of the photoreceptor for electrophotography of the invention contains, as the charge-transporting agents having an arylaminophenyl group in the molecule, one or more p-terphenyl compounds represented by the following general formula (7):

[Chem. 7]

(7)

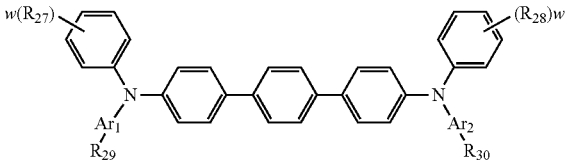

(wherein R27 and R28 may be the same or different and each represent a hydrogen atom, an alkyl group having 1-8 carbon atoms, an alkoxy group having 1-8 carbon atoms, a halogen atom, or a mono- or di-substituted amino group; w is an integer of 1 or 2; when w=2, then the two substituents bonded to the same phenyl group may be the same or different; Ar1 and Ar2 may be the same or different and each represent a substituted or unsubstituted divalent aromatic hydrocarbon group; and R29 and R30 each represent a hydrogen atom, an alkyl group having 1-8 carbon atoms, an alkoxy group having 1-8 carbon atoms, a substituted or unsubstituted aralkyl group, a halogen atom, or a di-substituted amino group).

In the invention, the aromatic hydroxycarboxylic acid metal complex represented by general formula (1) is added in an amount of preferably 0.01-0.35% by mass, more preferably 0.05-0.2% by mass, based on the charge-transporting agents having an arylaminophenyl group in the molecule. When the amount of the metal complex added is smaller than 0.01% by mass, there are cases where a sufficient durability-improving effect is not obtained. On the other hand, in case where the amount thereof exceeds 0.35% by mass, a higher durability-improving effect tends to be not obtained and such a large amount is disadvantageous from the standpoint of cost.

The invention furthermore provides a process for producing a photoreceptor for electrophotography which has a photosensitive layer containing a charge-transporting agent having an arylaminophenyl group in the molecule and has excellent durability, by adding an aromatic hydroxycarboxylic acid metal complex represented by general formula (1) in an amount of preferably 0.01-0.35% by mass, more preferably 0.05-0.2% by mass, based on the charge-transporting agent in the photoreceptor for electrophotography.

ADVANTAGES OF THE INVENTION

According to the invention, a charge-transporting agent having an arylaminophenyl group and a metal complex of an aromatic hydroxycarboxylic acid are used in combination. Thereby, changes in charge potential and residual potential are little, and only a small amount of additives is required. Therefore, a photoreceptor which does not impair basic performances of electrophotography and which has excellent stability to repeated use can be provided.

DESCRIPTION OF THE REFERENCE NUMERALS

Figure 1:
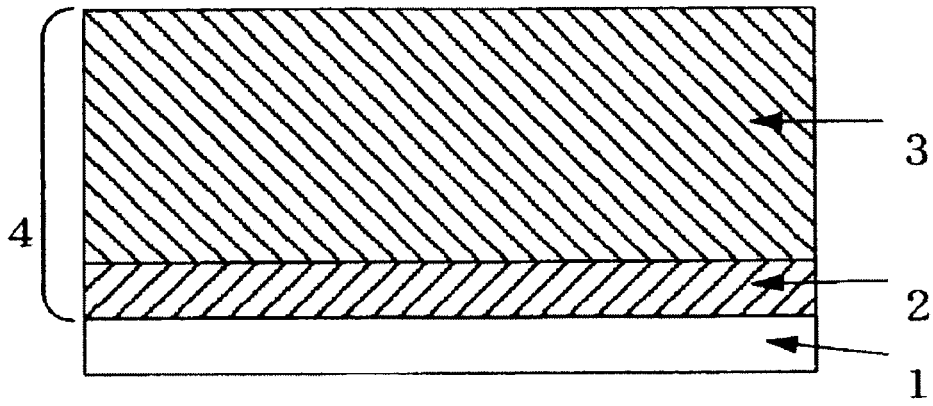
FIG. 1 is a diagrammatic sectional view illustrating the layer constitution of a function allocation type photoreceptor for electrophotography.

1 Conductive support
2 Charge-generating layer
3 Charge-transporting layer
4 Photosensitive layer
5 Undercoat layer
6 Layer containing charge-transporting substance
7 Charge-generating substance
8 Protective layer

BEST MODE FOR CARRYING OUT THE INVENTION

There are various forms of photosensitive layer. The photosensitive layer of the photoreceptor for electrophotography of the invention may have any of the forms. Photoreceptors employing typical examples of the various forms are shown in FIG. 1 to FIG. 7.

Figure 2:
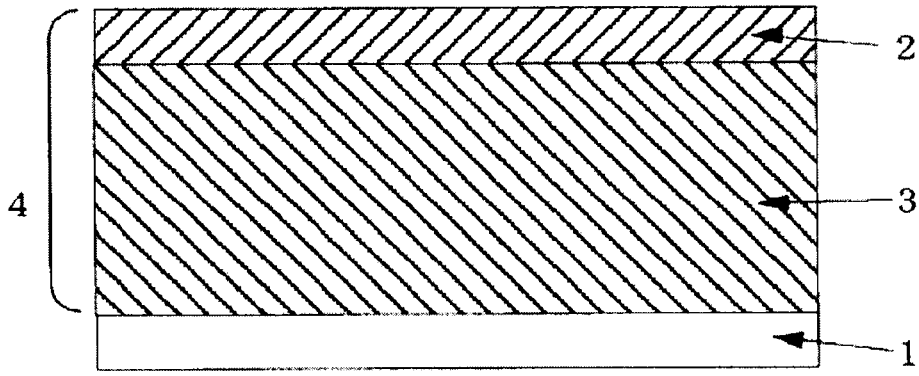
FIG. 2 is a diagrammatic sectional view illustrating the layer constitution of another function allocation type photoreceptor for electrophotography.
Figure 3:
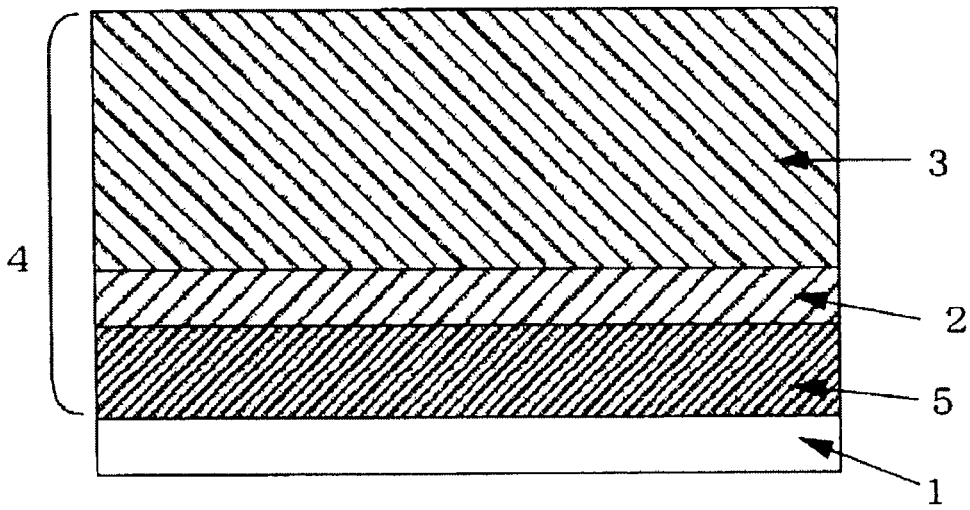
FIG. 3 is a diagrammatic sectional view illustrating the layer constitution of a function allocation type photoreceptor for electrophotography which has an undercoat layer formed between a charge-generating layer and a conductive support.
Figure 4:
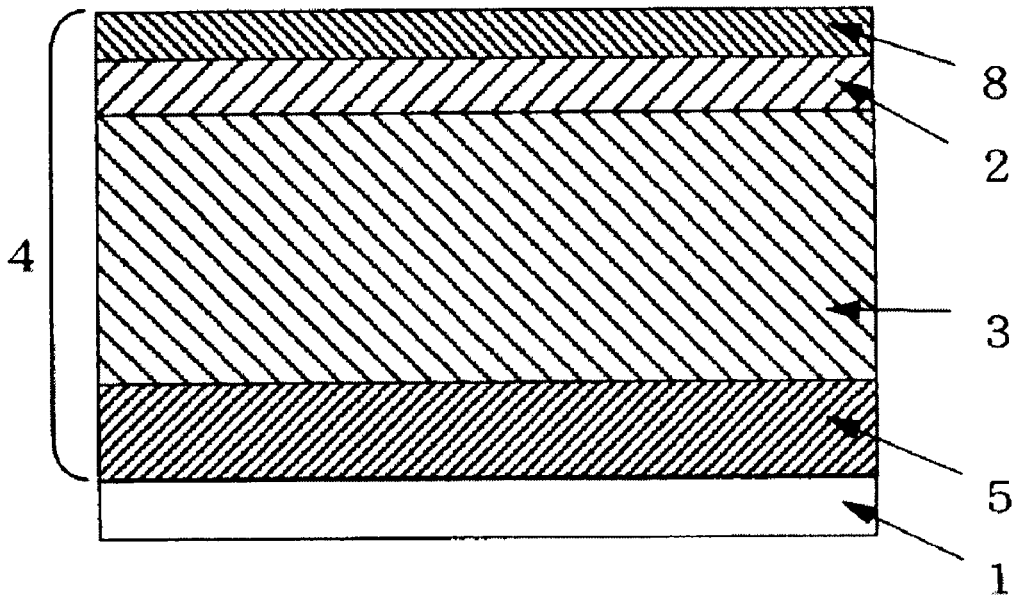
FIG. 4 is a diagrammatic sectional view illustrating the layer constitution of a function allocation type photoreceptor for electrophotography which has an undercoat layer formed between a charge-transporting layer and a conductive support and further has a protective layer formed on a charge-generating layer.
Figure 5:
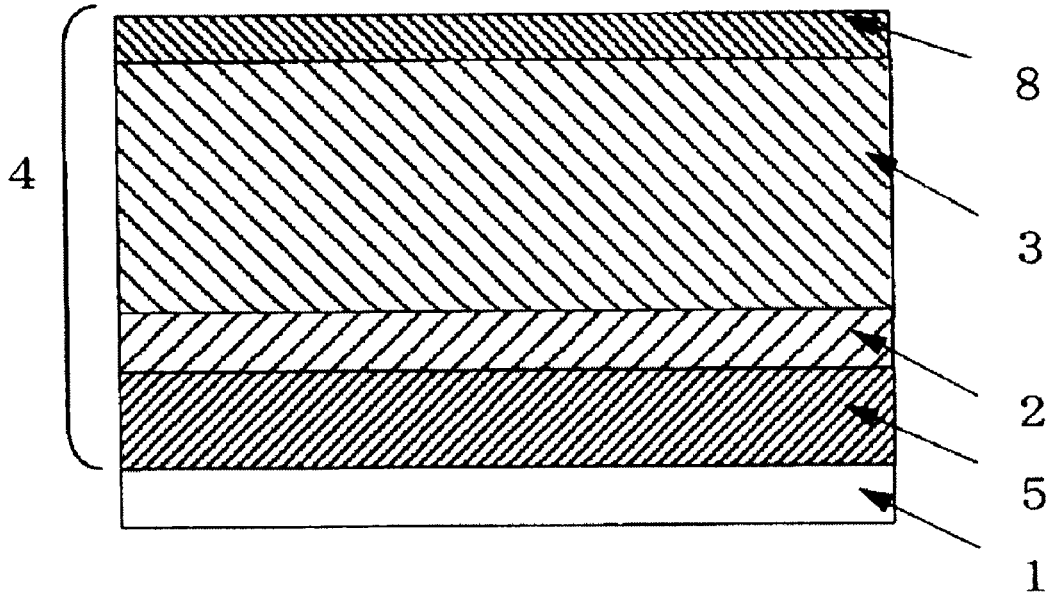
FIG. 5 is a diagrammatic sectional view illustrating the layer constitution of a function allocation type photoreceptor for electrophotography which has an undercoat layer formed between a charge-generating layer and a conductive support and further has a protective layer formed on a charge-transporting layer.
Figure 6:
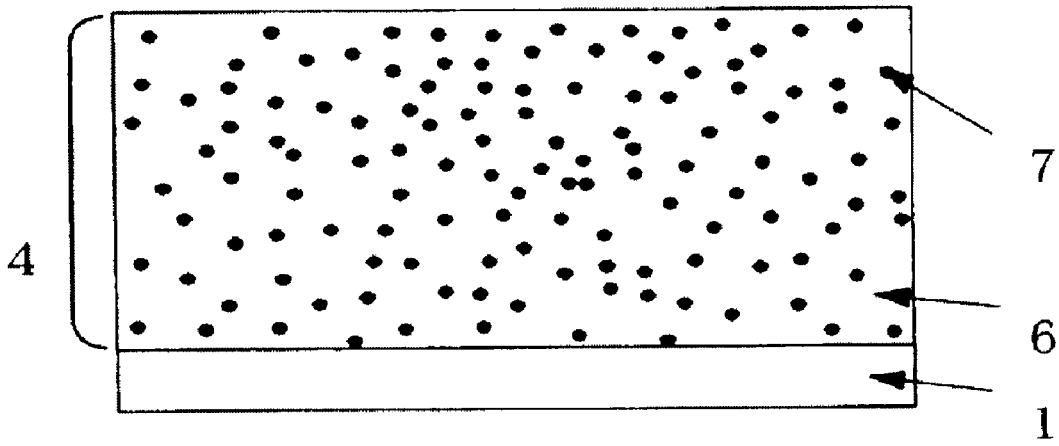
FIG. 6 is a diagrammatic sectional view illustrating the layer constitution of a single-layer type photoreceptor for electrophotography.
Figure 7:
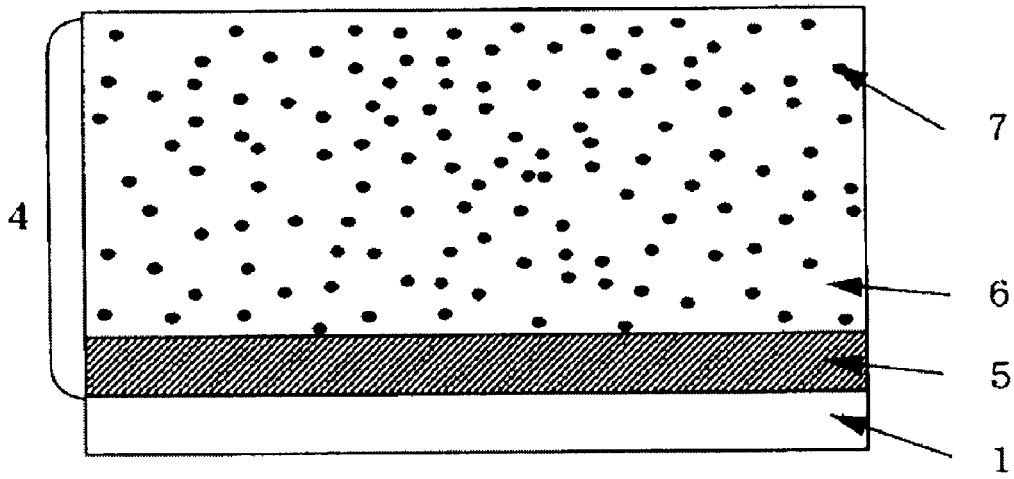
FIG. 7 is a diagrammatic sectional view illustrating the layer constitution of a single-layer type photoreceptor for electrophotography which has an undercoat layer formed between a photosensitive layer and a conductive support.

FIG. 1 and FIG. 2 show photoreceptors each constituted of a conductive support 1 and a photosensitive layer 4 formed thereon which has a multilayer structure composed of a charge-generating layer 2 containing a charge-generating substance as a main component and a charge-transporting layer 3 containing a charge-transporting substance and a binder resin as main components. In such constitutions, the photosensitive layer 4 may be formed via an undercoat layer 5 for charge regulation formed on the conductive support, as shown in FIG. 3, FIG. 4, and FIG. 5. A protective layer 8 may be formed as an outermost layer. Furthermore, in the invention, a photosensitive layer 4 constituted of a layer 6 which contains a charge-transporting substance and a binder resin as main components and further contains a charge-generating substance 7 dissolved or dispersed in the layer 6 may be formed directly or via an undercoat layer 5 over a conductive support 1 as shown in FIG. 6 and FIG. 7.

The photoreceptor of the invention can be produced by ordinary methods in the following manners. For example, an aromatic hydroxycarboxylic acid metal complex represented by general formula (1) described above and one or more specific amine compounds represented by any of general formulae (2) to (7) are dissolved in an appropriate solvent together with a binder resin. According to need, a charge-generating substance, an electron-attracting compound, and other ingredients such as a plasticizer and a pigment are added to the solution to prepare a coating fluid. This coating fluid is applied to a conductive support and dried to form a photosensitive layer of several micrometers to tens of micrometers. Thus, a photoreceptor can be produced. In the case of a photosensitive layer composed of two layers, i.e., a charge-generating layer and a charge-transporting layer, a photoreceptor can be produced by a method in which a coating fluid prepared by dissolving an aromatic hydroxycarboxylic acid metal complex represented by general formula (1) and one or more specific amine compounds represented by any of general formulae (2) to (7) in an appropriate solvent together with a binder resin and adding ingredients such as a plasticizer and a pigment to the resultant solution is applied to a charge-generating layer. Alternatively, a photoreceptor of that kind can be produced by applying that coating fluid to obtain a charge-transporting layer and forming a charge-generating layer thereon. According to need, an undercoat layer and a protective layer may be formed in the photoreceptors thus produced.

The hydrazone compounds represented by general formulae (2) to (4) to be used in the invention can be obtained according to production processes or synthesis examples which have been reported (see, for example, patent document 4). The styryl compounds represented by general formula (5) to be used in the invention can also be obtained according to production processes or synthesis examples which have been reported (see, for example, patent document 5). The benzidine compounds represented by general formula (6) to be used in the invention can be obtained according to production processes or synthesis examples which have been reported (see, for example, patent document 6). Furthermore, the p-terphenyl compounds represented by general formula (7) to be used in the invention can be obtained according to production processes or synthesis examples which have been reported (see, for example, patent document 6).

Patent Document 4: JP-A-9-202762
Patent Document 5: JP-A-8-211636
Patent Document 6: JP-A-7-126225

The metal complex of an aromatic hydroxycarboxylic acid to be used in the invention can be generally obtained by a process in which the aromatic hydroxycarboxylic acid is reacted with a metal imparter using water and/or an organic solvent and the resultant reaction product is taken out by filtration and washed. The compound thus obtained is not a metal salt but a metal complex. This compound can be obtained according to production processes or synthesis examples which have been reported (see, for example, patent documents 7 to 9).

Patent Document 7: JP-B-55-042752
Patent Document 8: JP-A-61-069073
Patent Document 9: JP-B-8-010360

Examples of the aromatic hydroxycarboxylic acid metal complex represented by general formula (1) to be used in the invention, which can be obtained by such processes, include the compounds shown in Table 1. Examples thereof further include the iron complex of 3,5-di-tert-butylsalicylic acid, nickel complex of 3,5-di-tert-butylsalicylic acid, cobalt complex of 3,5-di-tert-butylsalicylic acid, iron complex of 3-n-butyl-5-tert-butylsalicylic acid, aluminum complex of 3-n-butyl-5-tert-butylsalicylic acid, nickel complex of 3-n-butyl-5-tert-butylsalicylic acid, cobalt complex of 3-n-butyl-5-tert-butylsalicylic acid, iron complex of 3,5-di-n-butylsalicylic acid, zinc complex of 3,5-di-n-butylsalicylic acid, aluminum complex of 3,5-di-n-butylsalicylic acid, nickel complex of 3,5-di-n-butylsalicylic acid, cobalt complex of 3,5-di-n-butylsalicylic acid, iron complex of 3,5-diisopropylsalicylic acid, zinc complex of 3,5-diisopropylsalicylic acid, aluminum complex of 3,5-diisopropylsalicylic acid, manganese complex of 3,5-diisopropylsalicylic acid, cobalt complex of 3,5-diisopropylsalicylic acid, iron complex of 3-hydroxy-2-naphthoic acid, zinc complex of 3-hydroxy-2-naphthoic acid, aluminum complex of 3-hydroxy-2-naphthoic acid, nickel complex of 3-hydroxy-2-naphthoic acid, titanium complex of 3-hydroxy-2-naphthoic acid, iron complex of 3-tert-butyl-5-methylsalicylic acid, zinc complex of 3-tert-butyl-5-methylsalicylic acid, aluminum complex of 3-tert-butyl-5-methylsalicylic acid, manganese complex of 3-tert-butyl-5-methylsalicylic acid, titanium complex of 3-tert-butyl-5-methylsalicylic acid, iron complex of 3,5-diisopropenylsalicylic acid, zinc complex of 3,5-diisopropenylsalicylic acid, aluminum complex of 3,5-diisopropenylsalicylic acid, nickel complex of 3,5-diisopropenylsalicylic acid, cobalt complex of 3,5-diisopropenylsalicylic acid, iron complex of 3,5-bis(n-butan-2-enyl)salicylic acid, zinc complex of 3,5-bis(n-butan-2-enyl)salicylic acid, aluminum complex of 3,5-bis(n-butan-2-enyl)salicylic acid, nickel complex of 3,5-bis(n-butan-2-enyl)salicylic acid, cobalt complex of 3,5-bis(n-butan-2-enyl)salicylic acid, manganese complex of 3,5-bis(n-butan-2-enyl)salicylic acid, and titanium complex of 3,5-bis(n-butan-2-enyl)salicylic acid. However, the metal complex to be used in the invention should not be construed as being limited to these examples.

TABLE 1

| Metal Complex No. | Compound Example |
|---|---|
| 1 | 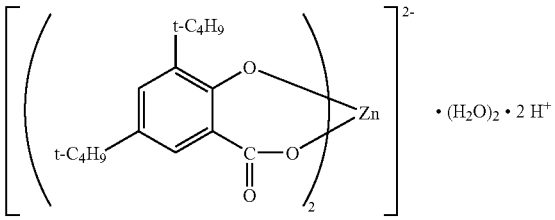 • $(H_2O)_2$ • 2 $H^+$ |
| 2 | 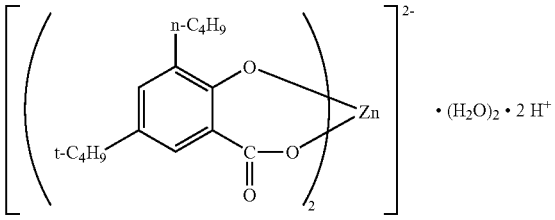 • $(H_2O)_2$ • 2 $H^+$ |
| 3 | 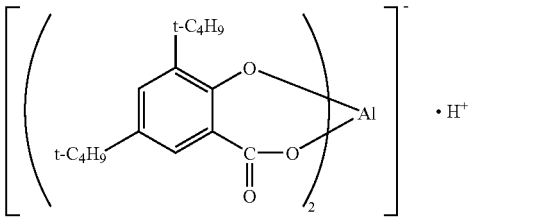 • $H^+$ |

As the conductive support on which the photosensitive layer according to the invention is to be formed, materials used in known photoreceptors for electrophotography can be employed. Examples thereof include a drum or sheet of a metal such as aluminum, aluminum alloy, stainless steel, copper, zinc, vanadium, molybdenum, chromium, titanium, nickel, indium, gold, or platinum, a laminate of any of these metals, a support having a vapor-deposited coating of any of these metals, a plastic film, plastic drum, paper, or paper tube which has undergone a conductivity-imparting treatment including applying a conductive substance, such as a metal powder, carbon black, copper iodide, or polymeric electrolyte, together with an appropriate binder, a plastic film or plastic drum to which conductivity has been imparted by incorporating a conductive substance thereinto, or the like.

An undercoat layer containing a resin or containing a resin and a pigment may be formed between the conductive support and the photosensitive layer according to need. The pigment to be dispersed in the undercoat layer may be a powder in general use. However, a white or nearly white pigment which shows almost no absorption in a near infrared region is desirable when sensitivity enhancement is taken into account. Examples of such pigments include metal oxides represented by titanium oxide, zinc oxide, tin oxide, indium oxide, zirconium oxide, alumina, and silica. Ones which have no hygroscopicity and fluctuate little with environment are desirable.

The resin to be used for forming the undercoat layer desirably is a resin having high resistance to general organic solvents because a photosensitive layer is to be formed on the undercoat layer by coating fluid application using a solvent. Examples of such resins include water-soluble resins such as poly(vinyl alcohol), casein, and poly(sodium acrylate), alcohol-soluble resins such as copolymer nylons and methoxymethylated nylons, and curable resins forming a three-dimensional network structure, such as polyurethanes, melamine resins, and epoxy resins.

The charge-generating layer in the invention is constituted of, for example, a charge-generating agent, a binder resin, and additives which are added according to need. Examples of processes for forming the layer include a method based on coating fluid application, vapor deposition, and CVD.

Examples of the charge-generating agent include phthalocyanine pigments such as titanylphthalocyanine oxide of various crystal forms, titanylphthalocyanine oxide giving a Cu-Kα X-ray diffraction spectrum having an intense peak at diffraction angles 2θ±0.2° of 9.3, 10.6, 13.2, 15.1, 20.8, 23.3, and 26.3, titanylphthalocyanine oxide having an intense peak at diffraction angles 2θ+0.2° of 7.5, 10.3, 12.6, 22.5, 24.3, 25.4, and 28.6, titanylphthalocyanine oxide having an intense peak at diffraction angles 2θ±0.2° of 9.6, 24.1, and 27.2, metal-free phthalocyanines of various crystal forms including τ-form and X-form, copper phthalocyanine, aluminum phthalocyanine, zinc phthalocyanine, α-form, β-form, and Y-form oxotitanylphthalocyanines, cobalt phthalocyanine, hydroxygallium phthalocyanine, chloroaluminum phthalocyanine, and chloroindium phthalocyanine; azo pigments such as azo pigments having a triphenylamine framework (see, for example, patent document 10), azo pigments having a carbazole framework (see, for example, patent document 11), azo pigments having a fluorene framework (see, for example, patent document 12), azo pigments having an oxadiazole framework (see, for example, patent document 13), azo pigments having a bisstilbene framework (see, for example, patent document 14), azo pigments having a dibenzothiophene framework (see, for example, patent document 15), azo pigments having a distyrylbenzene framework (see, for example, patent document 16), azo pigments having a distyrylcarbazole framework (see, for example, patent document 17), azo pigments having a distyryloxadiazole framework (see, for example, patent document 18), azo pigments having a stilbene framework (see, for example, patent document 19), trisazo pigments having a carbazole framework (see, for example, patent documents 20 and 21), azo pigments having an anthraquinone framework (see, for example, patent document 22), and bisazo pigments having a diphenylpolyene framework (see, for example, patent documents 23 to 27); perylene pigments such as perylenic acid anhydride and perylenic acid imide; polycyclic quinone pigments such as anthraquinone derivatives, anthanthrone derivatives, dibenzpyrenequinone derivatives, pyranthrone derivatives, violanthrone derivatives, and isoviolanthrone derivatives; diphenylmethane and triphenylmethane pigments; cyanine and azomethine pigments; and indigoid pigments, bisbenzimidazole pigments, azulenium salts, pyrylium salts, thiapyrylium salts, benzopyrylium salts, and squarylium salts. These may be used alone or as a mixture of two or more thereof according to need.

Patent Document 10: JP-A-53-132347
Patent Document 11: JP-A-53-095033
Patent Document 12: JP-A-54-022834
Patent Document 13: JP-A-54-012742
Patent Document 14: JP-A-54-017733
Patent Document 15: JP-A-54-021728
Patent Document 16: JP-A-53-133445
Patent Document 17: JP-A-54-017734
Patent Document 18: JP-A-54-002129
Patent Document 19: JP-A-53-138229
Patent Document 20: JP-A-57-195767
Patent Document 21: JP-A-57-195768
Patent Document 22: JP-A-57-202545
Patent Document 23: JP-A-59-129857
Patent Document 24: JP-A-62-267363
Patent Document 25: JP-A-64-079753
Patent Document 26: JP-B-3-034503
Patent Document 27: JP-B-4-052459

The binder resin to be used in the charge-generating layer is not particularly limited. Examples thereof include polycarbonates, polyarylates, polyesters, polyamides, polyethylene, polystyrene, polyacrylates, polymethacrylates, poly(vinyl butyral), poly(vinyl acetal), poly(vinyl formal), poly(vinyl alcohol), polyacrylonitrile, polyacrylamide, styrene/acrylic copolymers, styrene/maleic anhydride copolymers, acrylonitrile/butadiene copolymers, polysulfones, polyethersulfones, silicone resins, and phenoxy resins. These may be used alone or as a mixture of two or more thereof according to need.

Examples of the additives which are used according to need include antioxidants, ultraviolet absorbers, light stabilizers, dispersants, adhesives, and sensitizers. The charge-generating layer produced from the materials described above may have a thickness of 0.1-2.0 μm, preferably 0.1-1.0 μm.

The charge-transporting layer in the invention can be formed, for example, by dissolving the charge-transporting agent, an aromatic hydroxycarboxylic acid metal complex represented by formula (1), and a binder resin in a solvent optionally together with an electron-accepting substance and additives, applying the resultant coating fluid to the charge-generating layer or to the conductive support or undercoat layer, and then drying the coating fluid applied.

Examples of the binder resin to be used for the charge-transporting layer include various resins compatible with the charge-transporting agent and additives, such as polymers and copolymers of vinyl compounds, e.g., styrene, vinyl acetate, vinyl chloride, acrylic esters, methacrylic esters, and butadiene, poly(vinyl acetal), polycarbonates (see, for example, patent documents 28 to 31), polyesters, poly(phenylene oxide), polyurethane, cellulose esters, phenoxy resins, silicone resins, and epoxy resins. These may be used alone or as a mixture of two or more thereof according to need. The amount of the binder resin to be used is generally in the range of 0.4-10 times by mass, preferably 0.5-5 times by mass, the amount of the charge-transporting agent. Specific examples of especially effective resins include polycarbonate resins such as "Yupilon Z" (manufactured by Mitsubishi Engineering-Plastic Corp.) and "Bisphenol A/Biphenol Copolycarbonate" (manufactured by Idemitsu Kosan Co., Ltd.).

Patent Document 28: JP-A-60-172044
Patent Document 29: JP-A-62-247374
Patent Document 30: JP-A-63-148263
Patent Document 31: JP-A-2-254459

The solvent to be used for forming the charge-transporting layer is not particularly limited so long as the charge-transporting agent, binder resin, electron-accepting substance, and additives are soluble therein. Examples of usable solvent include polar organic solvents such as tetrahydrofuran, 1,4-dioxane, methyl ethyl ketone, cyclohexanone, acetonitrile, N,N-dimethylformamide, and ethyl acetate, aromatic organic solvents such as toluene, xylene, and chlorobenzene, and chlorinated hydrocarbon solvents such as chloroform, trichloroethylene, dichloromethane, 1,2-dichloroethane, and carbon tetrachloride. These may be used alone or as a mixture of two or more thereof according to need.

An electron-accepting substance can be incorporated into the photosensitive layer in the invention for the purpose of improving sensitivity, reducing residual potential, or diminishing fatigue in repeated use. Examples of the electron-accepting substance include succinic anhydride, maleic anhydride, dibromosuccinic anhydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene, tetracyanoquinodimethane, o-dinitrobenzene, m-dinitrobenzene, 1,3,5-trinitrobenzene, p-nitrobenzonitrile, picryl chloride, quinone chlorimide, chloranil, bromanil, dichlorodicyano-p-benzoquinone, anthraquinone, dinitroanthraquinone, 2,3-dichloro-1,4-naphthoquinone, 1-nitroanthraquinone, 2-chloroanthraquinone, phenanthrenequinone, terephthalalmalenonitrile, 9-anthrylmethylidenemalenonitrile, 9-fluorenylidenemalenonitrile, polynitro-9-fluorenylidenemalenonitrile, 4-nitrobenzaldehyde, 9-benzoylanthracene, indanedione, 3,5-dinitrobenzophenone, 4-chloronaphthalic anhydride, 3-benzalphthalide, 3-(α-cyano-p-nitrobenzal)-4,5,6,7-tetrachlorophthalide, picric acid, o-nitrobenzoic acid, p-nitrobenzoic acid, 3,5-dinitrobenzoic acid, pentafluorobenzoic acid, 5-nitrosalicycli acid, 3,5-dinitrosalicyclic acid, phthalic acid, mellitic acid, and other compounds having a high electron affinity.

A surface-protective layer may be formed on the surface of the photoreceptor according to need. Examples of the material for the protective layer include a resin such as a polyester, polyamide, or the like, and a mixture of such a resin with a substance capable of regulating electrical resistance, such as a metal or a metal oxide. It is desirable that this surface-protective layer is as transparent as possible in a wavelength region in which the charge-generating agent shows light absorption.

The invention will be illustrated in greater detail by reference to the following Examples, but the invention should not be construed as being limited thereto. In the Examples, the "parts" are by mass and the concentrations are given in terms of % by mass.

EXAMPLE 1

In 13 parts of methanol was dissolved 1 part of an alcohol-soluble polyamide (Amilan CM-4000, manufactured by Toray Industries, Inc.). Thereto was added 5 parts of titanium oxide (Tipaque CR-EL, manufactured by Ishihala Sangyo Kaisha, Ltd.). The resultant mixture was treated with a paint shaker for 8 hours to disperse the titanium oxide and thereby produce a coating fluid for undercoat layer formation. Thereafter, the coating fluid was applied with a wire-wound bar to the aluminum side of a PET film having a vapor-deposited aluminum coating, and then dried to form an undercoat layer having a thickness of 1 μm.

Subsequently, 1.5 parts of titanylphthalocyanine oxide having a Cu-Kα X-ray diffraction spectrum having an intense peak at diffraction angles 2θ±0.2° of 7.5, 10.3, 12.6, 22.5, 24.3, 25.4, and 28.6 (charge-generating agent No. 1)

[Chem. 8]

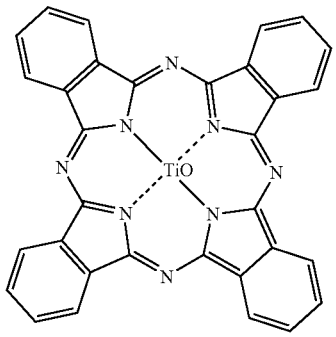

was added to 50 parts of a 3% cyclohexanone solution of a poly(vinyl butyral) resin (S-LEC BL-S, manufactured by Sekisui Chemical Co., Ltd.). The resultant mixture was treated with an ultrasonic disperser for 1 hour to disperse the charge-generating agent. The dispersion obtained was applied to the undercoat layer with a wire-wound bar and then dried at 110° C. and ordinary pressure for 1 hour to form a charge-generating layer having a thickness of 0.6 μm.

On the other hand, 0.1 part of an aromatic hydroxycarboxylic acid metal complex (metal complex No. 1) and 100 parts of the following benzidine compound as a charge-transporting agent (charge-transporting agent No. 1)

[Chem. 9]

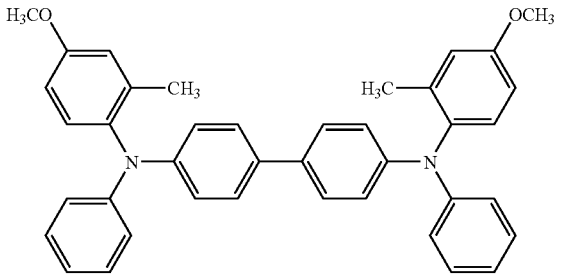

were added to 962 parts of a 13.0% tetrahydrofuran solution of a polycarbonate resin (Yupilon Z, manufactured by Mitsubishi Engineering-Plastic Corp.). The additive and charge-transporting agent were completely dissolved by propagating an ultrasonic wave thereto. This solution was applied to the charge-generating layer with a wire-wound bar and dried at 110° C. and ordinary pressure for 30 minutes to form a charge-transporting layer having a thickness of 20 μm. Thus, a photoreceptor was produced.

COMPARATIVE EXAMPLE 1

The same procedure as in Example 1 was conducted, except that the metal complex No. 1 was omitted. Thus, a comparative photoreceptor was produced.

EXAMPLE 2

A photoreceptor was produced in the same manner as in Example 1, except that titanylphthalocyanine oxide giving a Cu-Kα X-ray diffraction spectrum having an intense peak at diffraction angles 2θ±0.2° of 9.6, 24.1, and 27.2 (charge-generating agent No. 2) was used in place of the charge-generating agent No. 1 and that the following p-terphenyl compound (charge-transporting agent No. 2)

[Chem. 10]

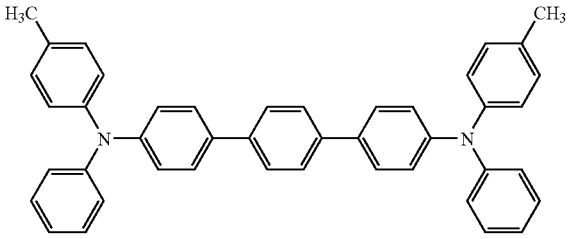

was used in place of the charge-transporting agent No. 1.

COMPARATIVE EXAMPLE 2

The same procedure as in Example 2 was conducted, except that the metal complex No. 1 was omitted. Thus, a comparative photoreceptor was produced.

EXAMPLE 3

A photoreceptor was produced in the same manner as in Example 2, except that the following styryl compound (charge-transporting agent No. 3)

[Chem. 11]

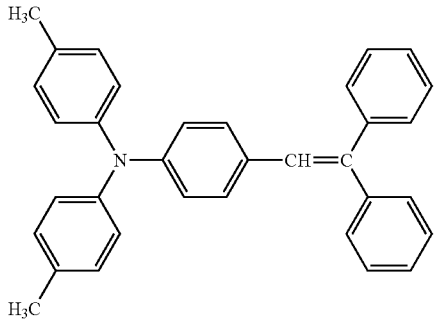

was used in place of the charge-transporting agent No. 2.

COMPARATIVE EXAMPLE 3

The same procedure as in Example 3 was conducted, except that the metal complex No. 1 was omitted. Thus, a comparative photoreceptor was produced.

EXAMPLE 4

Ten parts of an alcohol-soluble polyamide (Amilan CM-8000, manufactured by Toray Industries, Inc.) was dissolved in 190 parts of methanol. The resultant solution was applied with a wire-wound bar to the aluminum side of a PET film having a vapor-deposited aluminum coating, and then dried to form an undercoat layer having a thickness of 1 μm.

Subsequently, 1.5 parts of the following τ-form metal-free phthalocyanine as a charge-generating agent (charge-generating agent No. 3)

[Chem. 12]

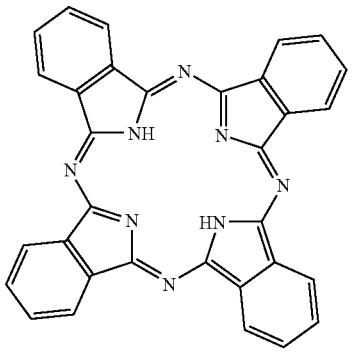

was added to 50 parts of a 3% cyclohexanone solution of a poly(vinyl butyral) resin (S-LEC BL-S, manufactured by Sekisui Chemical Co., Ltd.). The resultant mixture was treated with an ultrasonic disperser for 1 hour to disperse the charge-generating agent. The dispersion obtained was applied to the undercoat layer with a wire-wound bar and then dried at 110° C. and ordinary pressure for 1 hour to form a charge-generating layer having a thickness of 0.6 μm.

On the other hand, 0.1 part of metal complex No. 1 as an additive and 100 parts of the following hydrazone compound as a charge-transporting agent (charge-transporting agent No. 4)

[Chem. 13]

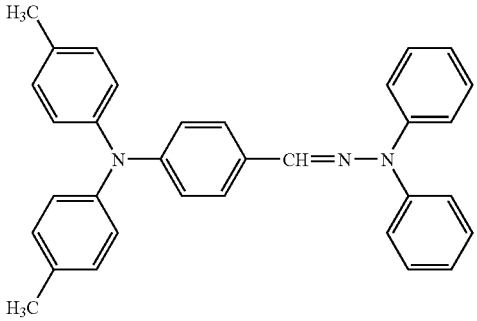

were added to 962 parts of a 13.0% tetrahydrofuran solution of a polycarbonate resin (Yupilon Z, manufactured by Mitsubishi Engineering-Plastic Corp.). The additive and charge-transporting agent were completely dissolved by propagating an ultrasonic wave thereto. This solution was applied to the charge-generating layer with a wire-wound bar and dried at 110° C. and ordinary pressure for 30 minutes to form a charge-transporting layer having a thickness of 20 μm. Thus, a photoreceptor was produced.

COMPARATIVE EXAMPLE 4

The same procedure as in Example 4 was conducted, except that the metal complex No. 1 was omitted. Thus, a comparative photoreceptor was produced.

COMPARATIVE EXAMPLE 5

The same procedure as in Example 4 was conducted, except that the following hydrazone compound (PR-36)

[Chem. 14]

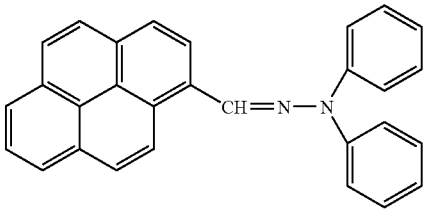

was used in place of the charge-transporting agent No. 4. Thus, a comparative photoreceptor was produced.

COMPARATIVE EXAMPLE 6

The same procedure as in Example 4 was conducted, except that the hydrazone compound (PR-36) was used in place of the charge-transporting agent No. 4 and that the metal complex No. 1 was omitted. Thus, a comparative photoreceptor was produced.

EXAMPLE 5

A photoreceptor was produced in the same manner as in Example 2, except that a 1:1 by mass mixture of the following styryl compound (charge-transporting agent No. 5)

[Chem. 15]

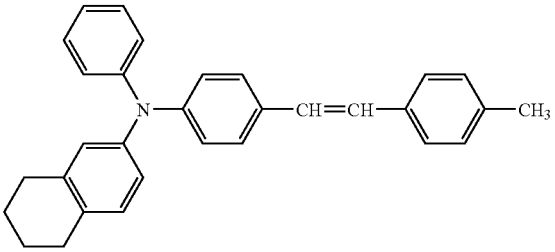

and the following styryl compound (charge-transporting agent No. 6)

[Chem. 16]

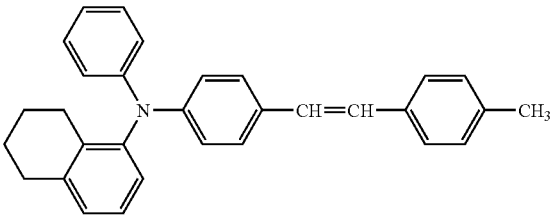

was used in place of the charge-transporting agent No. 2.

COMPARATIVE EXAMPLE 7

The same procedure as in Example 5 was conducted, except that the metal complex No. 1 was omitted. Thus, a comparative photoreceptor was produced.

EXAMPLE 6

To 83 parts of a cyclohexanone were added 1.0 part of the following bisazo pigment as a charge-generating agent (charge-generating agent No. 4)

[Chem. 17]

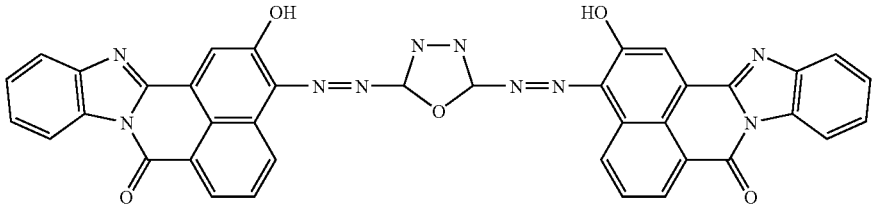

and 8.6 parts of a 5% cyclohexanone solution of a poly(vinyl butyral) resin (S-LEC BL-S, manufactured by Sekisui Chemical Co., Ltd.). The resultant mixture was subjected to a pulverization/dispersion treatment with a ball mill for 48 hours. The dispersion obtained was applied with a wire-wound bar to the aluminum side of a PET film having a vapor-deposited aluminum coating as a conductive support, and then dried to form a charge-generating layer having a thickness of 0.8 μm.

On the other hand, 0.1 part of the metal complex No. 1 and 100 parts of a 9:1 by mass mixture of the following styryl compound as a charge-transporting agent (charge-transporting agent No. 7)

[Chem. 18]

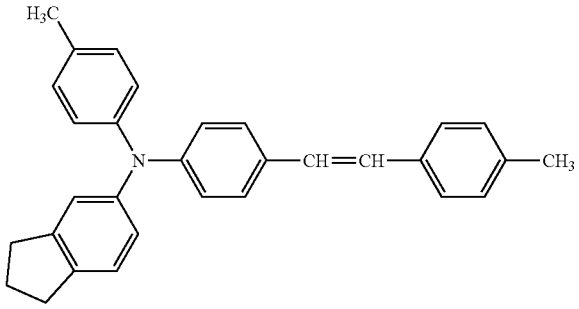

and the following styryl compound as another charge-transporting agent (charge-transporting agent No. 8)

[Chem. 19]

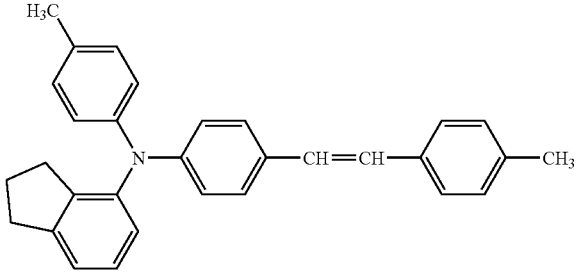

were added to 962 parts of a 13.0% tetrahydrofuran solution of a polycarbonate resin (Yupilon Z, manufactured by Mitsubishi Engineering-Plastic Corp.). The additive and p-terphenyl compounds were completely dissolved by propagating an ultrasonic wave thereto. This solution was applied to the charge-generating layer with a wire-wound bar and dried at 110° C. and ordinary pressure for 30 minutes to form a charge-transporting layer having a thickness of 20 μm. Thus, a photoreceptor was produced.

COMPARATIVE EXAMPLE 8

The same procedure as in Example 6 was conducted, except that the metal complex No. 1 was omitted. Thus, a comparative photoreceptor was produced.

EXAMPLE 7

The photoreceptors produced in Examples 1 to 5 and Comparative Examples 1 to 7 were evaluated for electrophotographic characteristics with a photoreceptor drum characteristics measuring apparatus (trade name "ELYSIA-II" manufactured by TREK Japan K.K.). First, each photoreceptor was subjected to −5.7 kV corona discharge in the dark and subsequently illuminated with an erase lamp at 70 lx, and the resultant charge potential V0 was measured. Subsequently, this photoreceptor was subjected to imaging exposure to 780-nm monochromic light at 30 μW, and the residual potential Vr was determined. The charging and exposure were subsequently repeated 1,000 times, and this photoreceptor was then examined for charge potential V0 and residual potential Vr. The results obtained are shown in Table 2.

TABLE 2

| Example and Comparative Example | Charge-generating agent No. | Charge-transporting agent No. | Metal complex No. | Charge potential V0 (−V) Initial | Charge potential V0 (−V) 1000-time repetitions | Residual potential Vr (−V) Initial | Residual potential Vr (−V) 1000-time repetitions |
|---|---|---|---|---|---|---|---|
| Example 1 | 1 | 1 | 1 | 622 | 619 | 12 | 10 |
| Comparative Example 1 | 1 | 1 | — | 630 | 610 | 26 | 23 |
| Example 2 | 2 | 2 | 1 | 677 | 664 | 12 | 10 |
| Comparative Example 2 | 2 | 2 | — | 673 | 645 | 15 | 10 |
| Example 3 | 2 | 3 | 1 | 660 | 660 | 14 | 16 |
| Comparative Example 3 | 2 | 3 | — | 662 | 668 | 25 | 30 |
| Example 4 | 3 | 4 | 1 | 660 | 662 | 12 | 20 |
| Comparative Example 4 | 3 | 4 | — | 661 | 670 | 21 | 45 |
| Comparative Example 5 | 3 | PR-36 | 1 | 665 | 675 | 92 | 138 |
| Comparative Example 6 | 3 | PR-36 | — | 673 | 689 | 135 | 203 |
| Example 5 | 2 | 5, 6 | 1 | 660 | 669 | 16 | 18 |
| Comparative Example 7 | 2 | 5, 6 | — | 661 | 675 | 30 | 45 |

The photoreceptors produced in Example 6 and Comparative Example 8 were evaluated for electrophotographic characteristics with a photoreceptor drum characteristics measuring apparatus (trade name "ELYSIA-II" manufactured by TREK Japan K.K.). First, each photoreceptor was subjected to −5.0 kV corona discharge in the dark and subsequently illuminated with an erase lamp at 70 lx, and the resultant charge potential V0 was measured. Subsequently, this photoreceptor was subjected to imaging exposure to white light at 40 lx, and the residual potential Vr was determined. The charging and exposure were subsequently repeated 1,000 times, and this photoreceptor was then examined for charge potential V0 and residual potential Vr. The results obtained are shown in Table 3.

TABLE 3

| Example and Comparative Example | Charge-generating agent No. | Charge-transporting agent No. | Metal complex No. | Charge potential V0 (−V) Initial | Charge potential V0 (−V) 1000-time repetitions | Residual potential Vr (−V) Initial | Residual potential Vr (−V) 1000-time repetitions |
|---|---|---|---|---|---|---|---|
| Example 6 | 4 | 7, 8 | 1 | 700 | 700 | 5 | 5 |
| Comparative Example 8 | 4 | 7, 8 | — | 700 | 710 | 8 | 13 |

It can be seen from the results of the Examples and Comparative Examples given above that a photoreceptor for electrophotography which changes little in charge potential and residual potential and has excellent durability can be provided by using one or more charge-transporting agents having an arylaminophenyl group in the molecule in combination with the aromatic hydroxycarboxylic acid metal complex according to the invention.

While the invention has been described in detail and with reference to specific embodiments thereof, it will be apparent to one skilled in the art that various changes and modifications can be made therein without departing from the spirit and scope thereof.

This application is based on Japanese Patent Application No. 2006-014036 filed on Jan. 23, 2006, the contents thereof being herein incorporated by reference.

INDUSTRIAL APPLICABILITY

The photoreceptor for electrophotography obtained by the invention has a low residual potential even in an initial stage, changes little in electrophotographic characteristics, and is useful as an electrophotographic photoreceptor capable of realizing high durability.

The invention claimed is:

1. A photoreceptor for electrophotography, which comprises a conductive support and a photosensitive layer formed on the support, the photosensitive layer comprising an aromatic hydroxycarboxylic acid metal complex represented by formula (1):

(1)

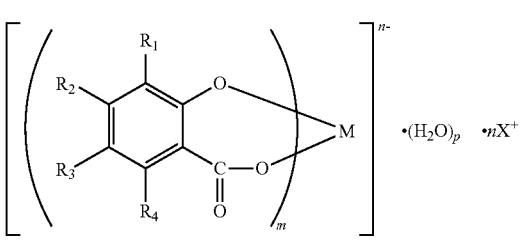

wherein R1, R2, R3, and R4 may be the same or different and each represent hydrogen, a linear or branched alkyl group having 1-8 carbon atoms, or a linear or branched alkenyl group having 2-8 carbon atoms, provided that R1 and R2, or R2 and R3, or R3 and R4 may be bonded to each other to form a ring; M represents a metal; X represents a cation; m is an integer of 1-3; n is an integer of 1 or 2; and p is an integer of 0-3;and one or more charge-transporting agents each having an arylaminophenyl group in the molecule.

2. The photoreceptor according to claim 1, wherein in formula (1), R1 and R3 each are an alkyl group having 1-8 carbon atoms, R2 and R4 each are hydrogen, M is a metal having a valence of 2 (excluding Hg) or 3 (excluding Cr), and X is a monovalent cation.

3. The photoreceptor according to claim 2, wherein the photosensitive layer comprises, as the charge-transporting agents having an arylaminophenyl group in the molecule, one or more hydrazone compounds represented by formula (2), (3), or (4):

(2)

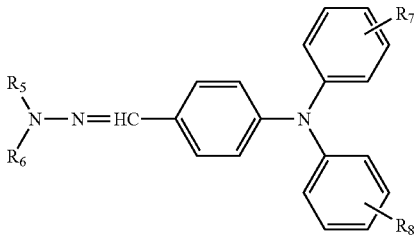

wherein R5 and R6 may be the same or different and each represent a linear or branched alkyl group having 1-12 carbon atoms, a substituted or unsubstituted linear aralkyl group having 7-20 carbon atoms, a substituted or unsubstituted branched aralkyl group having 7-20 carbon atoms, or a substituted or unsubstituted aryl group having 1-4 rings; and R7 and R8 may be the same or different and each represent a hydrogen atom, a linear or branched alkyl group having 1-12 carbon atoms, a substituted or unsubstituted linear aralkyl group having 7-20 carbon atoms, a substituted or unsubstituted branched aralkyl group having 7-20 carbon atoms, a linear or branched alkoxy group having 1-4 carbon atoms, a substituted or unsubstituted aryloxy group, an acyl group, an alkoxycarbonyl group having 2-5 carbon atoms, a halogen atom, a nitro group, an amino group substituted with one or two alkyl groups having 1-4 carbon atoms, or a substituted or unsubstituted amide group; provided that when R5 to R8 further have a substituent, then the substituent may be a halogen atom, alkoxy group, aryloxy group, dialkylamino group, or alkylthio group, and that R5 or R6 may further have an alkyl group only when it is an aryl group;

(3)

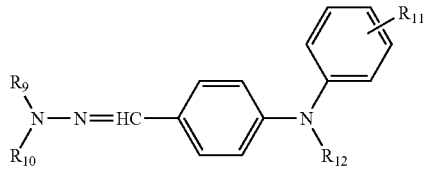

wherein R9 and R10 may be the same or different and each represent a linear or branched alkyl group having 1-12 carbon atoms, a substituted or unsubstituted linear aralkyl group having 7-20 carbon atoms, a substituted or unsubstituted branched aralkyl group having 7-20 carbon atoms, or a substituted or unsubstituted aryl group having 1-4 rings; R11 represents a hydrogen atom, a linear or branched alkyl group having 1-12 carbon atoms, a substituted or unsubstituted linear aralkyl group having 7-20 carbon atoms, a substituted or unsubstituted branched aralkyl group having 7-20 carbon atoms, a linear or branched alkoxy group having 1-4 carbon atoms, a substituted or unsubstituted aryloxy group, an acyl group, an alkoxycarbonyl group having 2-5 carbon atoms, a halogen atom, a nitro group, an amino group substituted with one or two alkyl groups having 1-4 carbon atoms, or a substituted or unsubstituted amide group; and R12 represents a linear or branched alkyl group having 1-12 carbon atoms, a substituted or unsubstituted linear aralkyl group having 1-12 carbon atoms, or a substituted or unsubstituted branched aralkyl group having 1-12 carbon atoms; provided that when R9 to R12 further have a substituent, then the substituent may be a halogen atom, alkoxy group, aryloxy group, dialkylamino group, or alkylthio group, and that R9 or R10 may further have an alkyl group only when it is an aryl group;

(4)

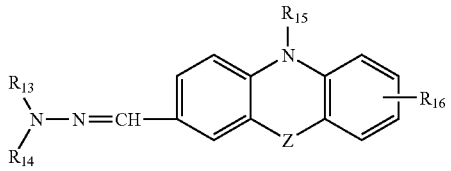

wherein Z represents O, S, or a divalent group represented by N(R15); R13 and R14 may be the same or different and each represent a linear or branched alkyl group having 1-12 carbon atoms, a substituted or unsubstituted linear aralkyl group having 7-20 carbon atoms, a substituted or unsubstituted branched aralkyl group having 7-20 carbon atoms, or a substituted or unsubstituted aryl group having 1-4 rings; R16 represents a hydrogen atom, a linear or branched alkyl group having 1-12 carbon atoms, a substituted or unsubstituted linear aralkyl group having 7-20 carbon atoms, a substituted or unsubstituted branched aralkyl group having 7-20 carbon atoms, a linear or branched alkoxy group having 1-4 carbon atoms, a substituted or unsubstituted aryloxy group, an acyl group, an alkoxycarbonyl group having 2-5 carbon atoms, a halogen atom, a nitro group, an amino group substituted with one or two alkyl groups having 1-4 carbon atoms, or a substituted or unsubstituted amide group; and R15 represents a linear or branched alkyl group having 1-12 carbon atoms, a substituted or unsubstituted linear aralkyl group having 1-12 carbon atoms, or a substituted or unsubstituted branched aralkyl group having 1-12 carbon atoms; provided that when R13 to R16 further have a substituent, then the substituent may be a halogen atom, alkoxy group, aryloxy group, dialkylamino group, or alkylthio group, and that R13 or R14 may further have an alkyl group only when it is an aryl group.

4. The photoreceptor according to claim 2, wherein the photosensitive layer comprises, as the charge-transporting agents having an arylaminophenyl group in the molecule, one or more styryl compounds represented by formula (5):

(5)

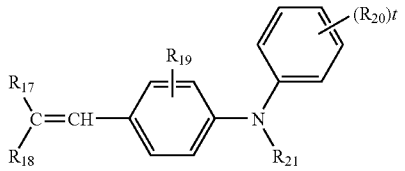

wherein R17 and R18 may be the same or different and each represent a substituted or unsubstituted phenyl group, a substituted or unsubstituted naphthyl group, a substituted or unsubstituted anthryl group, a substituted or unsubstituted fluorenyl group, or a substituted or unsubstituted heterocyclic group, the substituents being any of an alkyl group, alkoxy group, halogen atom, hydroxyl group, and phenyl group, each of which may be further substituted;

R19 represents hydrogen, a halogen atom, an alkyl group having 1-8 carbon atoms, an alkoxy group having 1-8 carbon atoms, or a mono- or dialkylamino group; R20 represents a hydrogen atom, an alkyl group having 1-8 carbon atoms, an alkoxy group having 1-8 carbon atoms, a halogen atom, or a mono- or di-substituted amino group; t is an integer of 1 or 2; when t=2, then the two substituents may be the same or different and the two substituents may be bonded to each other to form a tetramethylene ring or trimethylene ring; and R21 represents a substituted or unsubstituted phenyl group, the substituent being any of an alkyl group, alkoxy group, halogen atom, hydroxyl group, and substituted or unsubstituted phenyl group, each of which may be further substituted.

5. The photoreceptor according to claim 2, wherein the photosensitive layer comprises, as the charge-transporting agents having an arylaminophenyl group in the molecule, one or more benzidine compounds represented by formula (6):

(6)

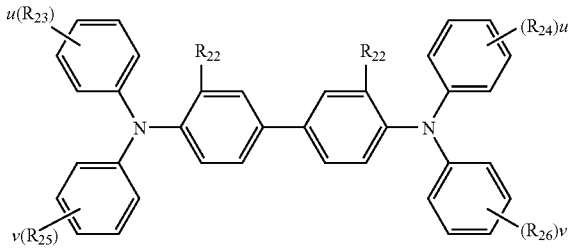

wherein R22 represents a hydrogen atom, an alkyl group having 1-8 carbon atoms, an alkoxy group having 1-8 carbon atoms, or a halogen atom; R23, R24, R25, and R26 may be the same or different and each represent a hydrogen atom, an alkyl group having 1-8 carbon atoms, an alkoxy group having 1-8 carbon atoms, a halogen atom, or a mono- or di-substituted amino group; u is an integer of 1 or 2; when u=2, then the two substituents bonded to the same phenyl group may be the same or different; v is an integer of 1 or 2; and when v=2, then the two substituents bonded to the same phenyl group may be the same or different.

6. The photoreceptor according to claim 2, wherein the photosensitive layer comprises, as the charge-transporting agents having an arylaminophenyl group in the molecule, one or more p-terphenyl compounds represented by the formula (7):

(7)

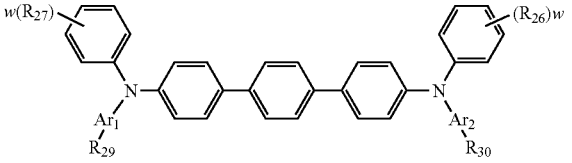

wherein R27 and R28 may be the same or different and each represent a hydrogen atom, an alkyl group having 1-8 carbon atoms, an alkoxy group having 1-8 carbon atoms, a halogen atom, or a mono- or di-substituted amino group; w is an integer of 1 or 2; when w=2, then the two substituents bonded to the same phenyl group may be the same or different; Ar1 and Ar2 may be the same or different and each represent a substituted or unsubstituted divalent aromatic hydrocarbon group; and R29 and R30 each represent a hydrogen atom, an alkyl group having 1-8 carbon atoms, an alkoxy group having 1-8 carbon atoms, a substituted or unsubstituted aralkyl group, a halogen atom, or a di-substituted amino group.

7. The photoreceptor according to claim 2, wherein metal M in formula (1) is at least one metal selected from the group consisting of Al, Co, Fe, Mn, Ni, Ti, and Zn.

8. The photoreceptor according to claim 2, wherein $X^+$ in formula (1) is one member selected from the group consisting of a hydrogen ion, alkali metal ions, an ammonium ion, and organic ammonium ions or is a monovalent cation comprising a mixture of two or more thereof.

9. The photoreceptor according to claim 2, wherein the aromatic hydroxycarboxylic acid metal complex represented by formula (1) is present in an amount of 0.01-0.35% by mass based on the mass of the charge-transporting agents having an arylaminophenyl group in the molecule.

10. The photoreceptor according to claim 1, wherein the photosensitive layer comprises, as the charge-transporting agents having an arylaminophenyl group in the molecule, one or more hydrazone compounds represented by formula (2), (3), or (4):

(2)

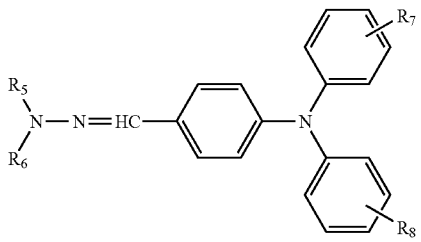

wherein R5 and R6 may be the same or different and each represent a linear or branched alkyl group having 1-12 carbon atoms, a substituted or unsubstituted linear aralkyl group having 7-20 carbon atoms, a substituted or unsubstituted branched aralkyl group having 7-20 carbon atoms, or a substituted or unsubstituted aryl group having 1-4 rings; and R7 and R8 may be the same or different and each represent a hydrogen atom, a linear or branched alkyl group having 1-12 carbon atoms, a substituted or unsubstituted linear aralkyl group having 7-20 carbon atoms, a substituted or unsubstituted branched aralkyl group having 7-20 carbon atoms, a linear or branched alkoxy group having 1-4 carbon atoms, a substituted or unsubstituted aryloxy group, an acyl group, an alkoxycarbonyl group having 2-5 carbon atoms, a halogen atom, a nitro group, an amino group substituted with one or two alkyl groups having 1-4 carbon atoms, or a substituted or unsubstituted amide group; provided that when R5 to R8 further have a substituent, then the substituent may be a halogen atom, alkoxy group, aryloxy group, dialkylamino group, or alkylthio group, and that R5 or R6 may further have an alkyl group only when it is an aryl group;

(3)

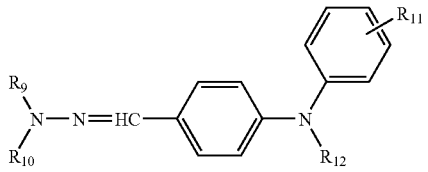

wherein R9 and R10 may be the same or different and each represent a linear or branched alkyl group having 1-12 carbon atoms, a substituted or unsubstituted linear aralkyl group having 7-20 carbon atoms, a substituted or unsubstituted branched aralkyl group having 7-20 carbon atoms, or a substituted or unsubstituted aryl group having 1-4 rings; R11 represents a hydrogen atom, a linear or branched alkyl group having 1-12 carbon atoms, a substituted or unsubstituted linear aralkyl group having 7-20 carbon atoms, a substituted or unsubstituted branched aralkyl group having 7-20 carbon atoms, a linear or branched alkoxy group having 1-4 carbon atoms, a substituted or unsubstituted aryloxy group, an acyl group, an alkoxycarbonyl group having 2-5 carbon atoms, a halogen atom, a nitro group, an amino group substituted with one or two alkyl groups having 1-4 carbon atoms, or a substituted or unsubstituted amide group; and R12 represents a linear or branched alkyl group having 1-12 carbon atoms, a substituted or unsubstituted linear aralkyl group having 1-12 carbon atoms, or a substituted or unsubstituted branched aralkyl group having 1-12 carbon atoms; provided that when R9 to R12 further have a substituent, then the substituent may be a halogen atom, alkoxy group, aryloxy group, dialkylamino group, or alkylthio group, and that R9 or R10 may further have an alkyl group only when it is an aryl group;

(4)

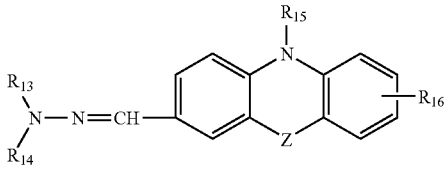

wherein Z represents O, S, or a divalent group represented by N(R15); R13 and R14 may be the same or different and each represent a linear or branched alkyl group having 1-12 carbon atoms, a substituted or unsubstituted linear aralkyl group having 7-20 carbon atoms, a substituted or unsubstituted branched aralkyl group having 7-20 carbon atoms, or a substituted or unsubstituted aryl group having 1-4 rings; R16 represents a hydrogen atom, a linear or branched alkyl group having 1-12 carbon atoms, a substituted or unsubstituted linear aralkyl group having 7-20 carbon atoms, a substituted or unsubstituted branched aralkyl group having 7-20 carbon atoms, a linear or branched alkoxy group having 1-4 carbon atoms, a substituted or unsubstituted aryloxy group, an acyl group, an alkoxycarbonyl group having 2-5 carbon atoms, a halogen atom, a nitro group, an amino group substituted with one or two alkyl groups having 1-4 carbon atoms, or a substituted or unsubstituted amide group; and R15 represents a linear or branched alkyl group having 1-12 carbon atoms, a substituted or unsubstituted linear aralkyl group having 1-12 carbon atoms, or a substituted or unsubstituted branched aralkyl group having 1-12 carbon atoms; provided that when R13 to R16 further have a substituent, then the substituent may be a halogen atom, alkoxy group, aryloxy group, dialkylamino group, or alkylthio group, and that R13 or R14 may further have an alkyl group only when it is an aryl group.

11. The photoreceptor according to claim 1, wherein the photosensitive layer comprises, as the charge-transporting agents having an arylaminophenyl group in the molecule, one or more styryl compounds represented by formula (5):

(5)

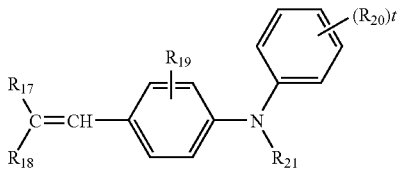

wherein R17 and R18 may be the same or different and each represent a substituted or unsubstituted phenyl group, a substituted or unsubstituted naphthyl group, a substituted or unsubstituted anthryl group, a substituted or unsubstituted fluorenyl group, or a substituted or unsubstituted heterocyclic group, the substituents being any of an alkyl group, alkoxy group, halogen atom, hydroxyl group, and phenyl group, each of which may be further substituted; R19 represents hydrogen, a halogen atom, an alkyl group having 1-8 carbon atoms, an alkoxy group having 1-8 carbon atoms, or a mono- or dialkylamino group; R20 represents a hydrogen atom, an alkyl group having 1-8 carbon atoms, an alkoxy group having 1-8 carbon atoms, a halogen atom, or a mono- or di-substituted amino group; t is an integer of 1 or 2; when t=2, then the two substituents may be the same or different and the two substituents may be bonded to each other to form a tetramethylene ring or trimethylene ring; and R21 represents a substituted or unsubstituted phenyl group, the substituent being any of an alkyl group, alkoxy group, halogen atom, hydroxyl group, and substituted or unsubstituted phenyl group, each of which may be further substituted.

12. The photoreceptor according to claim 1, wherein the photosensitive layer comprises, as the charge-transporting agents having an arylaminophenyl group in the molecule, one or more benzidine compounds represented by formula (6):

(6)

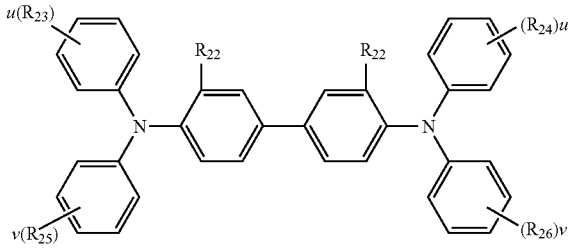

wherein R22 represents a hydrogen atom, an alkyl group having 1-8 carbon atoms, an alkoxy group having 1-8 carbon atoms, or a halogen atom; R23, R24, R25, and R26 may be the same or different and each represent a hydrogen atom, an alkyl group having 1-8 carbon atoms, an alkoxy group having 1-8 carbon atoms, a halogen atom, or a mono- or di-substituted amino group; u is an integer of 1 or 2; when u=2, then the two substituents bonded to the same phenyl group may be the same or different; v is an integer of 1 or 2; and when v=2, then the two substituents bonded to the same phenyl group may be the same or different.

13. The photoreceptor according to claim 1, wherein the photosensitive layer comprises, as the charge-transporting agents having an arylaminophenyl group in the molecule, one or more p-terphenyl compounds represented by formula (7):

(7)

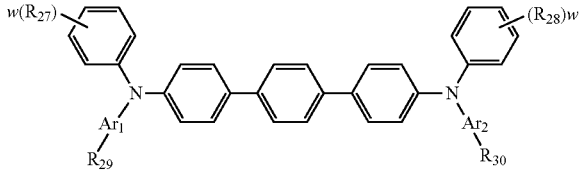

wherein R27 and R28 may be the same or different and each represent a hydrogen atom, an alkyl group having 1-8 carbon atoms, an alkoxy group having 1-8 carbon atoms, a halogen atom, or a mono- or di-substituted amino group; w is an integer of 1 or 2; when w=2, then the two substituents bonded to the same phenyl group may be the same or different; Ar1 and Ar2 may be the same or different and each represent a substituted or unsubstituted divalent aromatic hydrocarbon group; and R29 and R30 each represent a hydrogen atom, an alkyl group having 1-8 carbon atoms, an alkoxy group having 1-8 carbon atoms, a substituted or unsubstituted aralkyl group, a halogen atom, or a di-substituted amino group.

14. The photoreceptor according to claim 1, wherein metal M in formula (1) is at least one metal selected from the group consisting of Al, Co, Fe, Mn, Ni, Ti, and Zn.

15. The photoreceptor according to claim 1, wherein $X^+$ in formula (1) is one member selected from the group consisting of a hydrogen ion, alkali metal ions, an ammonium ion, and organic ammonium ions or is a monovalent cation comprising a mixture of two or more thereof.

16. The photoreceptor according to claim 1, wherein the aromatic hydroxycarboxylic acid metal complex represented by formula (1) is present in an amount of 0.01-0.35% by mass based on the mass of the charge-transporting agents having an arylaminophenyl group in the molecule.

17. A process for producing a photoreceptor for electrophotography, comprising forming on a conductive support a photosensitive layer comprising an aromatic hydroxycarboxylic acid metal complex represented by formula (1):

(1)

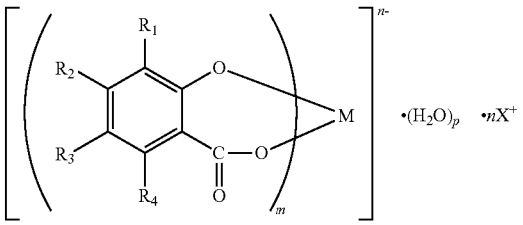

wherein R1, R2, R3, and R4 may be the same or different and each represent hydrogen, a linear or branched alkyl group having 1-8 carbon atoms, or a linear or branched alkenyl group having 2-8 carbon atoms, provided that R1 and R2, or R2 and R3, or R3 and R4 may be bonded to each other to form a ring; M represents a metal; X represents a cation; m is an integer of 1-3; n is an integer of 1 or 2; and p is an integer of 0-3 and one or more charge-transporting agents each having an arylaminophenyl group in the molecule.

18. The process according to claim 17, wherein in formula (1), R1 and R3 each are an alkyl group having 1-8 carbon atoms, R2 and R4 each are hydrogen, M is a metal having a valence of 2 (excluding Hg) or 3 (excluding Cr), and X is a monovalent cation.

19. The process according to claim 18, wherein metal M in formula (1) is at least one metal selected from the group consisting of Al, Co, Fe, Mn, Ni, Ti, and Zn.

20. The process according to claim 18, wherein $X^+$ in formula (1) is one member selected from the group consisting of a hydrogen ion, alkali metal ions, an ammonium ion, and organic ammonium ions or is a monovalent cation comprising a mixture of two or more thereof.

21. The process according to claim 18, wherein the aromatic hydroxycarboxylic acid metal complex represented by formula (1) is present in an amount of 0.01-0.35% by mass based on the mass of the charge-transporting agents having an arylaminophenyl group in the molecule.

22. The process according to claim 17, wherein metal M in formula (1) is at least one metal selected from the group consisting of Al, Co, Fe, Mn, Ni, Ti, and Zn.

23. The process according to claim 17, wherein $X^+$ in formula (1) is one member selected from the group consisting of a hydrogen ion, alkali metal ions, an ammonium ion, and organic ammonium ions or is a monovalent cation comprising a mixture of two or more thereof.

24. The process according to claim 17, wherein the aromatic hydroxycarboxylic acid metal complex represented by formula (1) is present in an amount of 0.01-0.35% by mass based on the mass of the charge-transporting agents having an arylaminophenyl group in the molecule.

* * * * *